US011118550B2

(12) United States Patent
Hußenether et al.

(10) Patent No.: US 11,118,550 B2
(45) Date of Patent: Sep. 14, 2021

(54) ASSEMBLED ROLLER TAPPET

(71) Applicant: Schaeffler Technologies AG & Co. KG, Herzogenaurach (DE)

(72) Inventors: Thomas Hußenether, Nuremberg (DE); Norbert Geyer, Höchstadt (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/754,644

(22) PCT Filed: Sep. 13, 2018

(86) PCT No.: PCT/DE2018/100776
§ 371 (c)(1),
(2) Date: Apr. 8, 2020

(87) PCT Pub. No.: WO2019/076396
PCT Pub. Date: Apr. 25, 2019

(65) Prior Publication Data

US 2020/0263645 A1 Aug. 20, 2020

(30) Foreign Application Priority Data

Oct. 18, 2017 (DE) ..... 10 2017 124 274.0

(51) Int. Cl.
*F02M 59/10* (2006.01)
*F04B 1/0426* (2020.01)
(Continued)

(52) U.S. Cl.
CPC ..... *F02M 59/102* (2013.01); *F04B 1/0426* (2013.01); *F01L 1/14* (2013.01);
(Continued)

(58) Field of Classification Search
CPC ..... F02M 59/102; F02M 59/44; F02M 2200/8053; F04B 1/0426; F04B 1/0417;
(Continued)

(56) References Cited

U.S. PATENT DOCUMENTS 3,977,370 A 8/1976 Humphreys
4,047,034 A 9/1977 Auphan
2016/0091075 A1* 3/2016 Berruet ..... F04B 9/042 74/569

FOREIGN PATENT DOCUMENTS

CN 102472218 A 5/2012
CN 103492702 A 1/2014
(Continued)

*Primary Examiner* — Zelalem Eshete
(74) *Attorney, Agent, or Firm* — Matthew V. Evans

(57) ABSTRACT

A roller tappet for a high-pressure fuel pump or for a valve drive of an internal combustion engine is provided. The tappet can be guided in a direction of a longitudinal axis thereof in a housing receptacle and can be driven displaceably by a cam shaft of the internal combustion engine. The tappet includes a tappet body which has a guide cylinder, and a cup-shaped sleeve supported axially and radially on the guide cylinder. The sleeve includes a bearing surface for the pump piston or a valve drive element, and the guide cylinder includes a rotatable roller mounted on support flanks, by means of which roller the roller tappet can be supported on the internal combustion engine camshaft. The sleeve has, at its end region facing away from the bearing surface, a ring-shaped shoulder for radial support and an end ring for axial support on the guide cylinder.

18 Claims, 1 Drawing Sheet

(51) Int. Cl.

| | |
|---|---|
| *F01L 1/14* | (2006.01) |
| *F02M 59/44* | (2006.01) |
| *F04B 1/0417* | (2020.01) |
| *F04B 1/0439* | (2020.01) |

(52) U.S. Cl.
CPC ..... *F01L 2305/00* (2020.05); *F01L 2307/00* (2020.05); *F02M 59/44* (2013.01); *F04B 1/0417* (2013.01); *F04B 1/0439* (2013.01)

(58) Field of Classification Search
CPC . F04B 1/0439; F01L 2307/00; F01L 2305/00; F01L 1/14; F01L 2303/00
See application file for complete search history.

(56) References Cited

FOREIGN PATENT DOCUMENTS

| | | | |
|---|---|---|---|
| CN | 105465310 | A | 4/2016 |
| CN | 105507975 | A | 4/2016 |
| DE | 2540061 | A1 | 5/1976 |
| DE | 2540861 | A | 5/1976 |
| DE | 102014220386 | B3 | 4/2016 |
| DE | 102017114326 | A | 1/2019 |
| JP | S6159016 | A | 3/1986 |
| JP | H06159016 | A | 6/1994 |
| WO | 0220953 | A | 2/2002 |
| WO | 2018184621 | A | 10/2018 |
| WO | 2018206029 | A | 11/2018 |

* cited by examiner

ASSEMBLED ROLLER TAPPET

CROSS-REFERENCE TO RELATED APPLICATIONS

This application is the U.S. National Phase of PCT Application No. PCT/DE2018/100776 filed on Sep. 13, 2018 which claims priority to DE 10 2017 124 274.0 filed on Octo-ber 18, 2017, the entire disclosures of which are incorporated by reference herein.

TECHNICAL FIELD

This disclosure relates to a roller tappet for a high-pressure fuel pump or for a valve gear of an internal combustion engine.

BACKGROUND

JP H0-6159016 A discloses a two-part roller tappet for a tappet rod mechanism. According to FIG. 2 (B), this has an elongate guide cylinder, which, in its lower section facing the camshaft, encloses a massive sleeve having a rotatable roller for cam contact.

Another roller tappet is known from DE 10 2017 114 326 by the applicant, although this has not yet been published. In the case of this roller tappet, the cup-shaped sleeve has, at the inner end thereof, a crossmember formed integrally thereon at an angle, which is used to support and guide the cup-shaped sleeve on the guide cylinder. As a result, the flow of force between the supporting flanks for roller support on the guide cylinder and the cup-shaped sleeve is embodied in an offset way, and therefore force transmission is limited.

SUMMARY

It is the object of the disclosure to make available a roller tappet which can be adapted at low cost to various sizes and various distances between the internal combustion engine shaft and the pump element or the valve gear element and, at the same time, has a rectilinear flow of force.

According to the disclosure, the object is achieved by virtue of the fact that the cup-shaped sleeve has, at an end region facing away from the bearing surface, an annular shoulder for radial support and an end ring for axial support on the guide cylinder.

The end ring can have recesses, which are connected to projections on the supporting flanks for roller support on the guide cylinder. As a result, the roller is connected operatively to the end ring along a straight line via the guide flanks, and said end ring is connected operatively to the cup-shaped sleeve along a straight line. The cup-shaped sleeve is ad-vantageously embodied as a drawn part, and the annular shoulder is produced by compressing or folding the sleeve to form an annular bead. By means of different forming levels, the distance between the bearing surface for the pump plunger or for a valve gear element and the annular shoulder and/or the end ring is embodied so as to be variable, and therefore the tappet body has different lengths for different distances between the internal combustion engine shaft and the pump plunger or the valve gear element. The fit between the annular shoulder and the inner wall of the guide cylinder is embodied as a pressure joint, and therefore the cup-shaped sleeve is also fixed axially in the guide cylinder.

DETAILED DESCRIPTION OF THE EMBODIMENTS

Figure 1:
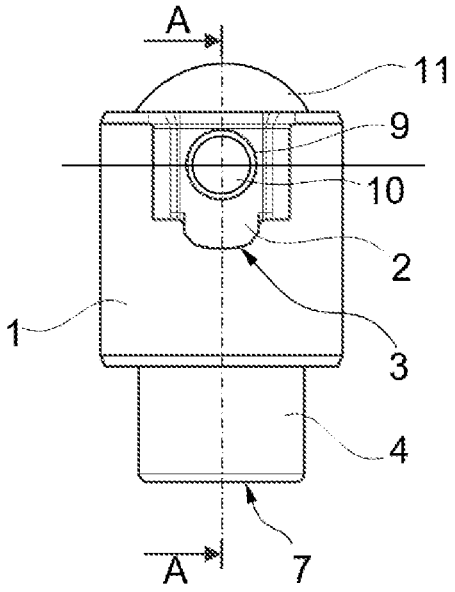
FIG. 1 shows a side view of a roller tappet according to the disclosure.
Figure 2:
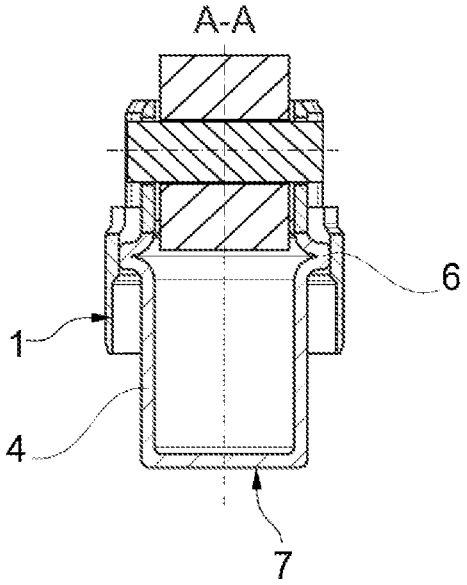
FIG. 2 shows a section through the roller tappet along the line A-A in FIG. 1.
Figure 3:
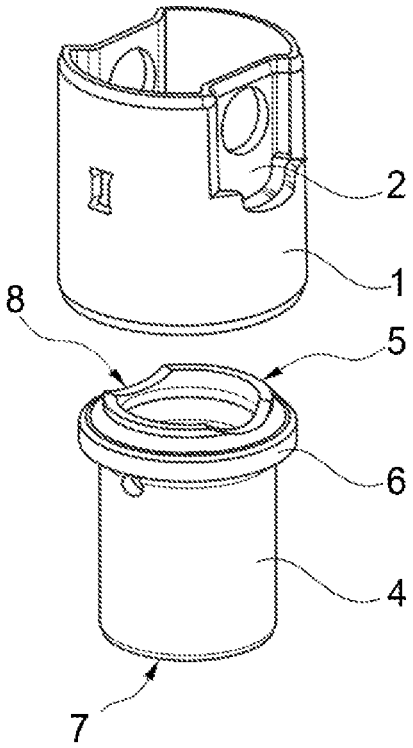
FIG. 3 shows an exploded illustration of the roller tappet with the guide cylinder and the cup-shaped sleeve.
Figure 4:
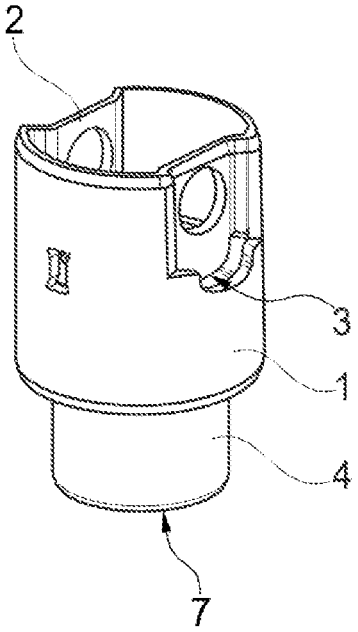
FIG. 4 shows the roller tappet according to FIG. 3 in an assembled embodiment.

In FIGS. 1 to 4, where illustrated in detail, 1 denotes a guide cylinder, which has flattened supporting flanks 2, in which holes 9 for a pin 10 of a roller 11 are machined. As can be seen especially from FIGS. 1, 3 and 4, the supporting flanks 2 have projections 3, which are aligned as an extension of the supporting flanks 2 in the interior of the guide cylinder. A cup-shaped sleeve 4, which has an end ring 5, an annular shoulder 6 and a bearing surface 7 for a pump plunger or a valve gear element, is fitted into the interior of the guide cylinder 1. Recesses 8 (see FIG. 3), which match projections 3 on the supporting flanks 2, are machined into the end ring 5. As can be seen from FIG. 2, a rectilinear flow of force is thereby established between the supporting flanks 2 and the cup-shaped sleeve 4, and the cup-shaped sleeve 4 is secured against rotation in the guide cylinder 1.

The cup-shaped sleeve 4 is embodied as a drawn part, and the annular shoulder 6 is produced by compressing or folding the cup-shaped sleeve 4 to form an annular bead. Depending on different forming levels, the distance between the bearing surface 7 and the end ring 5 or the annular shoulder 6 can be given different lengths. Adjacent to the annular shoulder 6, the guide cylinder 1 has a thickened portion, thus enabling the annular shoulder 6 to be fitted into the guide cylinder 1 by means of a press fit without the risk of impermissible expansion of the guide cylinder 1.

LIST OF REFERENCE CHARACTERS

1 guide cylinder
2 supporting flanks
3 projections
4 cup-shaped sleeve
5 end ring
6 annular shoulder
7 bearing surface
8 recesses
9 holes
10 pin
11 roller

The invention claimed is:

1. A roller tappet for an internal combustion engine, which roller tappet can be guided in a direction of a longitudinal axis thereof, the roller tappet comprising:

a guide cylinder, a rotatable roller mounted on supporting flanks of the guide cylinder, and a cup-shaped sleeve supported axially and radially on the guide cylinder, the cup-shaped sleeve including:

a bearing surface, an annular shoulder for radial support, and an end ring for axial support on the guide cylinder, and the end ring having recesses which are received by projections formed on the supporting flanks, and the annular shoulder and end ring located at an end region extending away from the bearing surface.

2. The roller tappet as claimed in claim 1, wherein the cup-shaped sleeve is embodied as a drawn part, and the annular shoulder is produced by compressing the sleeve to form an annular bead.

3. The roller tappet as claimed in claim 1, wherein a distance between the bearing surface and at least one of the annular shoulder or the end ring is embodied so as to be variable depending on different forming levels.

4. The roller tappet as claimed in claim 1, wherein the annular shoulder is fitted to an inner wall of the guide cylinder by a press fit.

5. A roller tappet configured for an internal combustion engine, the roller tappet comprising:

a guide cylinder, a roller mounted on supporting flanks of the guide cylinder, a cup-shaped sleeve including:

a first end having a bearing surface, at least one recess, and an annular shoulder, and the supporting flanks configured to engage with the at least one recess to: i) provide axial support of the sleeve, and ii) prevent rotation of the sleeve relative to the guide cylinder, and an inner wall of the guide cylinder configured to engage the annular shoulder to provide radial support of sleeve.

6. The roller tappet of claim 5, wherein the supporting flanks form at least one axial projection configured to be received by the at least one recess.

7. The roller tappet of claim 6, wherein a projection contour of the at least one axial projection matches a recess contour of the at least one recess.

8. The roller tappet of claim 7, wherein the projection contour and the recess contour are curved.

9. The roller tappet of claim 5, wherein the at least one recess is formed on a second end of the sleeve.

10. The roller tappet of claim 9, wherein the sleeve further comprises an end-ring that includes the at least one recess.

11. The roller tappet of claim 5, wherein the annular shoulder is attached to the inner wall of the guide cylinder by a press fit.

12. The roller tappet of claim 11, wherein a first wall portion of the guide cylinder that receives the annular shoulder is thicker than a second wall portion of the guide cylinder, the second wall portion extending toward the bearing surface and connected to the first wall portion.

13. The roller tappet of claim 5, wherein the annular shoulder is produced by folding the sleeve to form an annular bead.

14. A roller tappet for an internal combustion engine, the roller tappet comprising:

a guide cylinder, a rotatable roller mounted on supporting flanks of the guide cylinder, and a cup-shaped sleeve supported axially and radially on the guide cylinder, the cup-shaped sleeve including:

a first end having a bearing surface, the bearing surface arranged outside of the guide cylinder, an annular shoulder for radial support, and a second end having an end ring for axial support on the guide cylinder, and the end ring and supporting flanks defining a projection and a recess, the projection configured to engage the recess so as to prevent rotation of the sleeve relative to the cylinder.

15. The roller tappet of claim 14, wherein the projection extends in an axial direction to engage the recess.

16. The roller tappet of claim 15, wherein the annular shoulder is fitted to a radial inner wall of the guide cylinder via a press fit.

17. The roller tappet of claim 16, wherein the annular shoulder is arranged between the first end and the second end of the sleeve.

18. The roller tappet of claim 16, wherein the guide cylinder further comprises a thickened portion adjacent to the annular shoulder of the sleeve.

* * * * *